US006061849A

United States Patent [19]

Seals

[11] Patent Number: 6,061,849

[45] Date of Patent: May 16, 2000

[54] BEACH TOWEL WITH BUILT-IN POCKETS AND CARRYING HANDLE

[76] Inventor: Christopher Seals, 218 18th St. Apt. E, Huntington Beach, Calif. 92648

[21] Appl. No.: 09/263,272

[22] Filed: Mar. 5, 1999

[51] Int. Cl.[7] ..... B65D 30/10; A47G 9/06

[52] U.S. Cl. ..... 5/417; 5/485; 5/656; 383/4

[58] Field of Search ..... 6/417, 419, 420, 6/485, 656; 383/4

[56] References Cited

U.S. PATENT DOCUMENTS

| | | | |
|---|---|---|---|
| 2,420,344 | 5/1947 | Alexander | 4/417 X |
| 2,659,404 | 11/1953 | Kelsey | 383/4 |
| 4,097,944 | 7/1978 | Yulish | 5/419 |
| 5,110,219 | 5/1992 | Lopes | 5/417 X |
| 5,622,300 | 4/1997 | Robinson | 383/4 X |
| 5,629,071 | 5/1997 | Feldman | 5/419 X |
| 5,730,529 | 3/1998 | Fritz et al. | 5/417 X |

*Primary Examiner*—Michael F. Trettel
*Attorney, Agent, or Firm*—Goldstein & Canino

[57] ABSTRACT

A beach towel with built-in pockets and carrying handle including a towel. A pair of small pockets are secured to the towel. A large pocket is secured to the towel. A pair of side straps extend outwardly from first and second long edges of the towel inwardly with respect to a first short edge. A plurality of end straps extend outwardly from the first short edge in a spaced relationship. A pair of carrying handles are secured to the towel along the first short edge thereof.

2 Claims, 2 Drawing Sheets

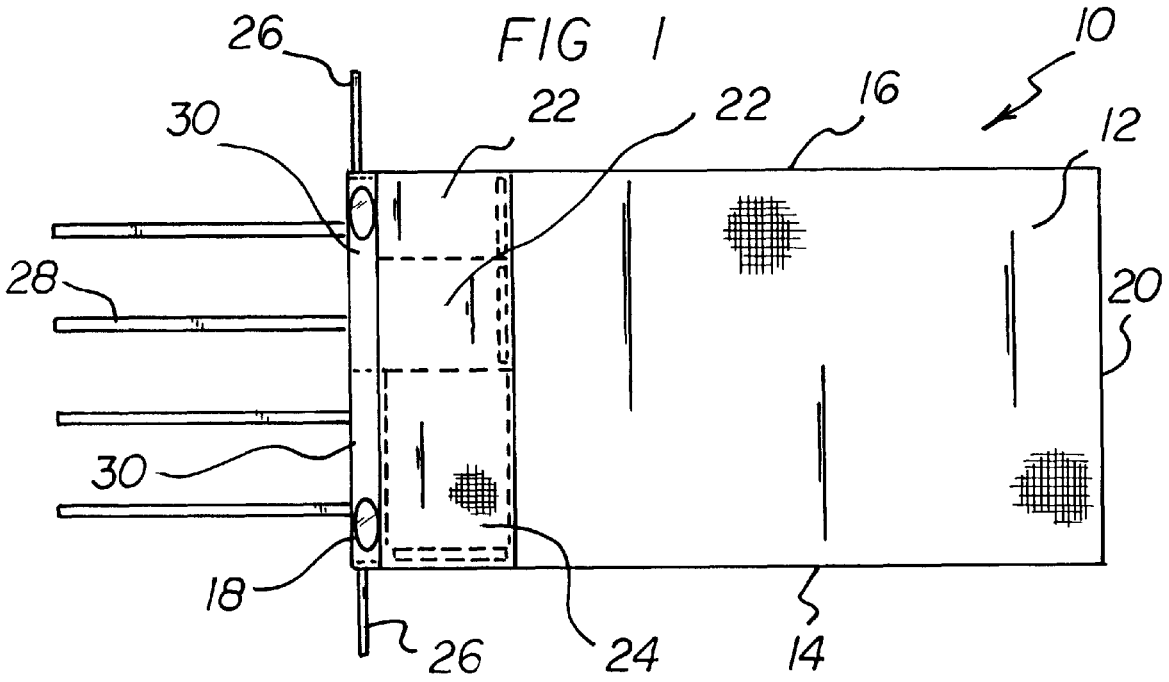
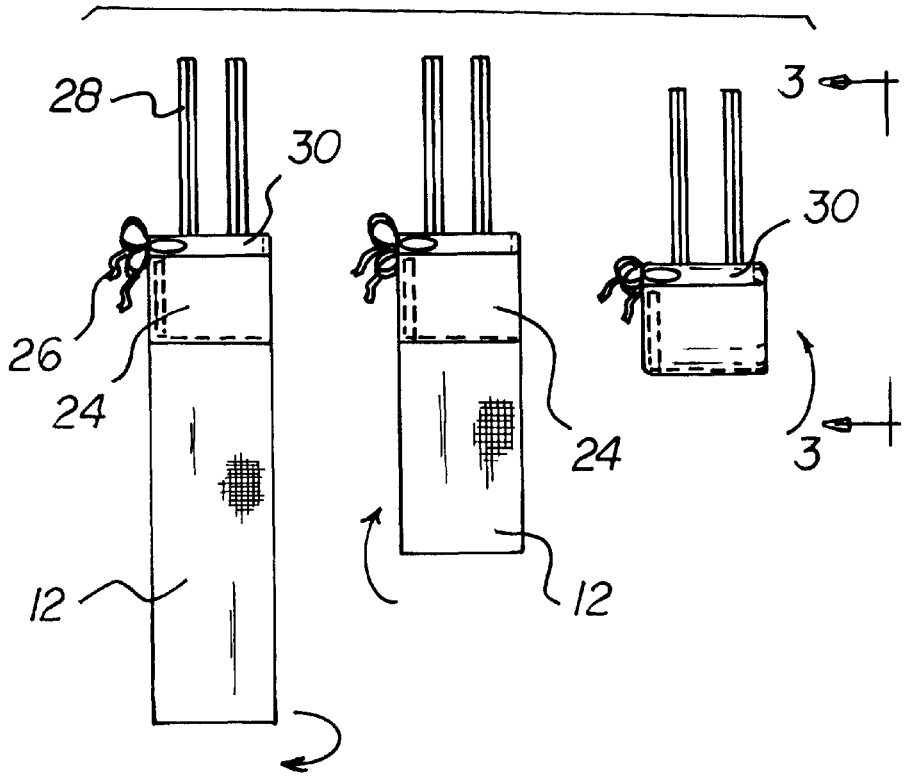
FIG 2

FIG 3
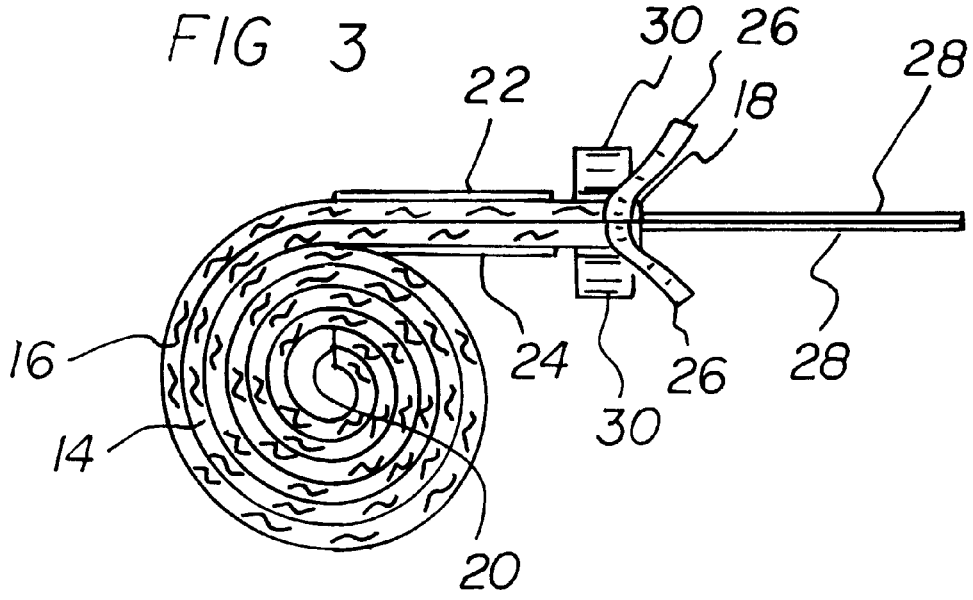
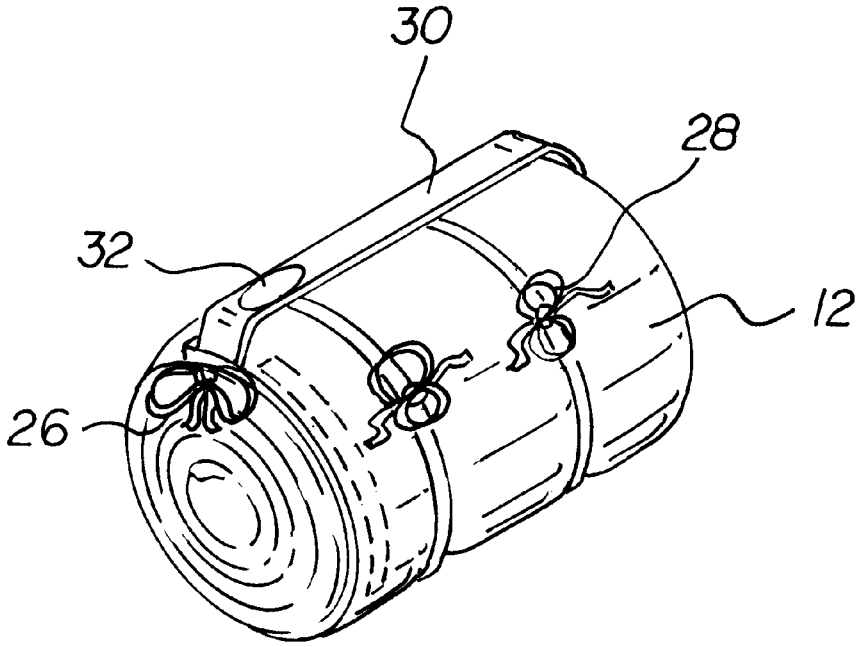
FIG 4

BEACH TOWEL WITH BUILT-IN POCKETS AND CARRYING HANDLE

BACKGROUND OF THE INVENTION

The present invention relates to a beach towel with built-in pockets and carrying handle and more particularly pertains to providing the ability to consolidate and carry items to a beach or the like.

Towels which convert into a carrying instrument are known in the art. These are occasions when people who go to the beach or pool desire to carry items that they will use when they reach their destination. There are a number of situations wherein there are space constraints which the ability of people to carry items necessary to engage in the activities to the site where such activities are to take place.

The use of beach accessories is known in the prior art. More specifically, beach accessories heretofore devised and utilized for the purpose of carrying accessory items are known to consist primarily of familiar, expected and obvious structural configurations, notwithstanding the myriad of designs encompassed by the crowded prior art which have been developed for the fulfillment of innumerable objectives and requirements.

By way of example, U.S. Pat. No. 5,629,071 to Feldman discloses a beach towel with three pockets, capable of being converted into a bag for carrying accessories. U.S. Pat. No. 5,103,515 to Bird discloses a blanket with a number of pockets, capable of being converted into a tote bag. U.S. Pat. Nos. Des. 335,236 to Wood, Des. 341,285 to Kraus, and Des. 379,730 to Dickman discloses various ornamental designs for beach towels with pockets.

While these devices fulfill their respective, particular objective and requirements, the aforementioned patents do not describe a beach towel with built-in pockets and carrying handle for providing the ability to consolidate and carry items to a beach or the like.

In this respect, the beach towel with built-in pockets and carrying handle according to the present invention substantially departs from the conventional concepts and designs of the prior art, and in doing so provides an apparatus primarily developed for the purpose of providing the ability to consolidate and carry items to a beach or the like.

Therefore, it can be appreciated that there exists a continuing need for new and improved beach towel with built-in pockets and carrying handle which can be used for providing the ability to consolidate and carry items to a beach or the like. In this regard, the present invention substantially fulfills this need.

SUMMARY OF THE INVENTION

In the view of the foregoing disadvantages inherent in the known types of beach accessories now present in the prior art, the present invention provides an improved beach towel with built-in pockets and carrying handle. As such, the general purpose of the present invention, which will be described subsequently in greater detail, is to provide a new and improved beach towel with built-in pockets and carrying handle and method which has all the advantages of the prior art and none of the disadvantages.

To attain this, the present invention essentially comprises a towel having a generally rectangular configuration. The towel is defined by opposed first and second long edges and opposed first and second short edges. A pair of small pockets are secured to the towel inwardly with respect to the first short edge. Each of the small pockets have an opening directed therein whereby the opening faces the second short edge. The openings have closure means associated therewith. A large pocket is secured to the towel inwardly with respect to the first short edge adjacent to the small pockets. The large pocket has an opening directed therein whereby the opening faces the first long edge. The opening has closure means associated therewith. The large pocket has a length and width essentially equal to a combined length and width of the small pockets. A pair of side straps extend outwardly from the first and second long edges of the towel inwardly with respect to the first short edge. A plurality of end straps extend outwardly from the first short edge in a spaced relationship. A pair of carrying handles are secured to the towel along the first short edge thereof. A first carrying handle extends widthwise across the pair of small pockets. A second carrying handle extends lengthwise along the large pocket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved beach towel with built-in pockets and carrying handle which has all the advantages of the prior art beach accessories and none of the disadvantages.

It is another object of the present invention to provide a new and improved beach towel with built-in pockets and carrying handle which may be easily and efficiently manufactured and marketed.

It is a further object of the present invention to provide a new and improved beach towel with built-in pockets and carrying handle which is of durable and reliable construction.

An even further object of the present invention is to provide a new and improved beach towel with built-in pockets and carrying handle which is susceptible of a low cost of manufacture with regard to both materials and labor, and which accordingly is then susceptible of low prices of sale to the consuming public, thereby making such a beach towel with built-in pockets and carrying handle economically available to the buying public.

Even still another object of the present invention is to provide a new and improved beach towel with built-in pockets and carrying handle for providing the ability to consolidate and carry items to a beach or the like.

Lastly, it is an object of the present invention to provide a new and improved beach towel with built-in pockets and carrying handle including a towel. A pair of small pockets are secured to the towel. A large pocket is secured to the towel. A pair of side straps extend outwardly from first and second long edges of the towel inwardly with respect to a first short edge. A plurality of end straps extend outwardly from the first short edge in a spaced relationship. A pair of carrying handles are secured to the towel along the first short edge thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of the preferred embodiment of the beach towel with built-in pockets and carrying handle constructed in accordance with the principles of the present invention.

FIG. 2 is a plan view of the present invention illustrated in the steps of folding into a carry bag.

FIG. 3 is a side view of the present invention as taken along line 3—3 of FIG. 2.

FIG. 4 is a perspective view of the present invention in the rolled orientation.

The same reference numerals refer to the same parts through the various figures.

DESCRIPTION OF THE PREFERRED EMBODIMENT

With reference now to the drawings, and in particular, to FIGS. 1 through 4 thereof, the preferred embodiment of the new and improved beach towel with built-in pockets and carrying handle embodying the principles and concepts of the present invention and generally designated by the reference number 10 will be described.

Specifically, it will be noted in the various Figures that the device relates to a beach towel with built-in pockets and carrying handle for providing the ability to consolidate and carry items to a beach or the like. In its broadest context, the device consists of a towel, a pair of small pockets, a large pocket, a pair of side straps, a plurality of end straps, and a pair of carrying handles. Such components are individually configured and correlated with respect to each other so as to attain the desired objective.

The towel 12 has a generally rectangular configuration. The towel 12 is defined by opposed first and second long edges 14,16 and opposed first and second short edges 18,20.

The pair of small pockets 22 are secured to the towel 12 inwardly with respect to the first short edge 18. Each of the small pockets 22 have an opening directed therein whereby the opening faces the second short edge 20. The openings have closure means associated therewith. The preferred closure means utilized by the present invention is hook and loop fasteners, although alternate closure means, such as zippers, buttons, and the like, could also be utilized.

The large pocket 24 is secured to the towel 12 inwardly with respect to the first short edge 18 adjacent to the small pockets 22. The large pocket 24 has an opening directed therein whereby the opening faces the first long edge 14. The opening has closure means associated therewith. As with the pair of small pockets 22, the preferred closure means is hook and loop fasteners. The large pocket 24 has a length and width essentially equal to a combined length and width of the small pockets 22.

The pair of side straps 26 extend outwardly from the first and second long edges 14,16 of the towel 12 inwardly with respect to the first short edge 18. The pair of side straps 26 will be ties together once the towel 12 is folded in half whereby the long side edges 14,16 are in alignment. Note FIG. 2. Once the side straps 26 are tied together, the towel 12 can be folded or rolled from the second short edge 20 up towards the first short edge 18. Note FIG. 3.

The plurality of end straps 28 extend outwardly from the first short edge 18 in a spaced relationship. Once the towel 12 has been folded or rolled, the end straps 28 can be extended in opposite directions around the towel 12 and then be tied together to facilitate closure of towel 12 in a compact orientation. Note FIG. 4.

The pair of carrying handles 30 are secured to the towel 12 along the first short edge 18 thereof. A first carrying handle extends widthwise across the pair of small pockets 22. A second carrying handle extends lengthwise along the large pocket 24. The carrying handles 30 can be utilized once the towel 12 is in the compact orientation, as in FIG. 4, to easily carry and transport the device 10. Each of the carrying handles 30 can be provided with indicia 32 thereon.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A beach towel with built-in pockets and carrying handle for providing the ability to consolidate and carry items to a beach or the like comprising, in combination:

a towel having a generally rectangular configuration, the towel being defined by opposed first and second long edges and opposed first and second short edges;

a pair of small pockets secured to the towel inwardly with respect to the first short edge, each of the small pockets having an opening directed therein whereby the opening faces the second short edge, the openings having closure means associated therewith;

a large pocket secured to the towel inwardly with respect to the first short edge adjacent to the small pockets, the large pocket having an opening directed therein whereby the opening faces the first long edge, the opening having closure means associated therewith, the large pocket having a length and width essentially equal to a combined length and width of the small pockets;

a pair of side straps extending outwardly from the first and second long edges of the towel inwardly with respect to the first short edge;

a plurality of end straps extending outwardly from the first short edge in a spaced relationship;

a pair of carrying handles secured to the towel along the first short edge thereof, a first carrying handle extending widthwise across the pair of small pockets, a second carrying handle extending lengthwise along the large pocket.

2. A beach towel with built-in pockets and carrying handle for providing the ability to consolidate and carry items to a beach or the like comprising, in combination:

a towel;

a pair of small pockets secured to the towel;

a large pocket secured to the towel;

a pair of side straps extending outwardly from first and second long edges of the towel inwardly with respect to a first short edge;

a plurality of end straps extending outwardly from the first short edge in a spaced relationship;

a pair of carrying handles secured to the towel along the first short edge thereof, wherein a first carrying handle extends widthwise across the pair of small pockets and a second carrying handle extends lengthwise along the large pocket.

* * * * *